United States Patent [19]

Keane

[11] Patent Number: 5,007,798

[45] Date of Patent: Apr. 16, 1991

[54] CENTRIFUGAL PUMP

[75] Inventor: Brian Keane, Clareville, Australia

[73] Assignee: Vaqua Limited, Frenchs Forest, Australia

[21] Appl. No.: 397,487

[22] PCT Filed: Dec. 15, 1987

[86] PCT No.: PCT/AU87/00423

§ 371 Date: Aug. 4, 1989

§ 102(e) Date: Aug. 4, 1989

[87] PCT Pub. No.: WO88/04733

PCT Pub. Date: Jun. 30, 1988

[30] Foreign Application Priority Data

Dec. 15, 1986 [AU] Australia ..... PH9514

[51] Int. Cl.[5] ..... F04D 1/12

[52] U.S. Cl. ..... 415/88; 415/169.1; 415/203; 415/206

[58] Field of Search ..... 415/203, 206, 169.1, 415/89, 88, 121.2; 417/61; 55/203, 204

[56] References Cited

U.S. PATENT DOCUMENTS 1,786,435 12/1930 Komfala ..... 415/183 X 4,416,586 11/1983 Diederich et al. ..... 415/169.1

4,439,200 3/1984 Meyer et al. ..... 406/99

FOREIGN PATENT DOCUMENTS 529613 12/1921 France ..... 415/122.1

OTHER PUBLICATIONS

AU,B, 4991/51 (158673) (Farm Technical Services Pty. Ltd.), Sep. 11, 1952.

GB,A 494469, The Candy Filter Company Ltd. et al, 11/1938.

GB,A, 901160 (Q.V.F. Limited et al), Jul. 18, 1962.

*Primary Examiner*—Edward K. Look

*Assistant Examiner*—Thomas Denion

*Attorney, Agent, or Firm*—Beveridge, DeGrandi & Weilacher

[57] ABSTRACT

A centrifugal pump for accommodating entrained gas and vapor at low absolute suction pressures includes an impeller with a central inlet chamber. The impeller has a peripheral wall which is concentric with the impeller's axis; and, at least one passage extends outwardly from an inlet port in the peripheral wall to an exit port radially spaced from the chamber. Preferably, the pump includes a stationary inlet port device located within the central inlet chamber for separating the spinning impeller from incoming fluid.

11 Claims, 6 Drawing Sheets

CENTRIFUGAL PUMP

TECHNICAL FIELD

The present invention relates to pumps for pumping liquids and mixtures of liquids and gases over a wide range of pressures and flow rates. In particular, the invention provides pumps which are capable of accommodating entrained gas and vapour at low absolute suction pressures.

The invention was developed for use with domestic vacuum distillation systems (desalinators) but it will be appreciated that the invention is not limited to this particular application.

DEFICIENCIES OF BACKGROUND ART

Problems are encountered when attempting to pump liquids, and particularly mixtures of liquids and gases, at low absolute suction pressures and low flow rates using a centrifugal device. These problems arise largely from the gas and vapour content of the flow, which is more prominent at lower pressures. These may be dissolved gases which separate at low pressures or the gaseous phase of the liquid itself.

At high flow rates in the order of hundreds of litres per minute, the flow velocity is such that entrained vapour tends to be purged from the system in the high velocity fluid flow. However, known centifugal pumps are unable to operate at low pressures of the order of 23 to 25 inches of mercury and low flow rates of the order of 300 mls per minute. In fact these known pumps are unable to accommodate significant quantities of gas and vapour at these pressures, regardless of the flow rate.

Problems are also encountered in providing reliable long lived seals for these pumps.

Disclosure of the Invention

According to the invention there is provided a centrifugal pump having an impellor mounted for rotation about an axis, said impellor having a central inlet chamber with a peripheral wall concentric with said axis and at least one passage extending outwardly from an inlet port in said wall to an exit port radially spaced from said chamber; wherein, stationery inlet port means are located within said chamber wherein, stationary inlet port means are located within said chamber for separating the spinning impellor from incoming fluid entering said inlet port means thereby to prevent induced rotation of said incoming fluid, said stationary inlet port means including an annular portion concentric with said axis and in substantial alignment with said impellor inlet port, at least one channel extending radially outwardly from the interior to the exterior of said annular portion for supplying said incoming of said impellor passage.

In this way the impellor is prevented from imparting a spinning velocity to the incoming fluid which would otherwise tend to separate the liquid from any entrained vapour and ultimately choke-off the supply entirely.

In a second aspect of the invention the impellor is located within its own delivery volume and wholly immersed in previously delivered fluid so as to deliver directly from said impellor to the previously delivered fluid. The impellor may be arranged at any desired orientation to the vertical. This provides a very simple pump with no peripheral structure since the delivery is directly from the impellor to the surrounding fluid.

The invention may also advantageously provide means for slowing the peripheral flow velocity of fluid immediately adjacent the impellor periphery.

BRIEF DESCRIPTION OF THE DRAWINGS

Preferred embodiments of the invention will now be described, by way of example only, with reference to the accompanying drawings in which.

PREFERRED EMBODIMENTS

Figure 1:
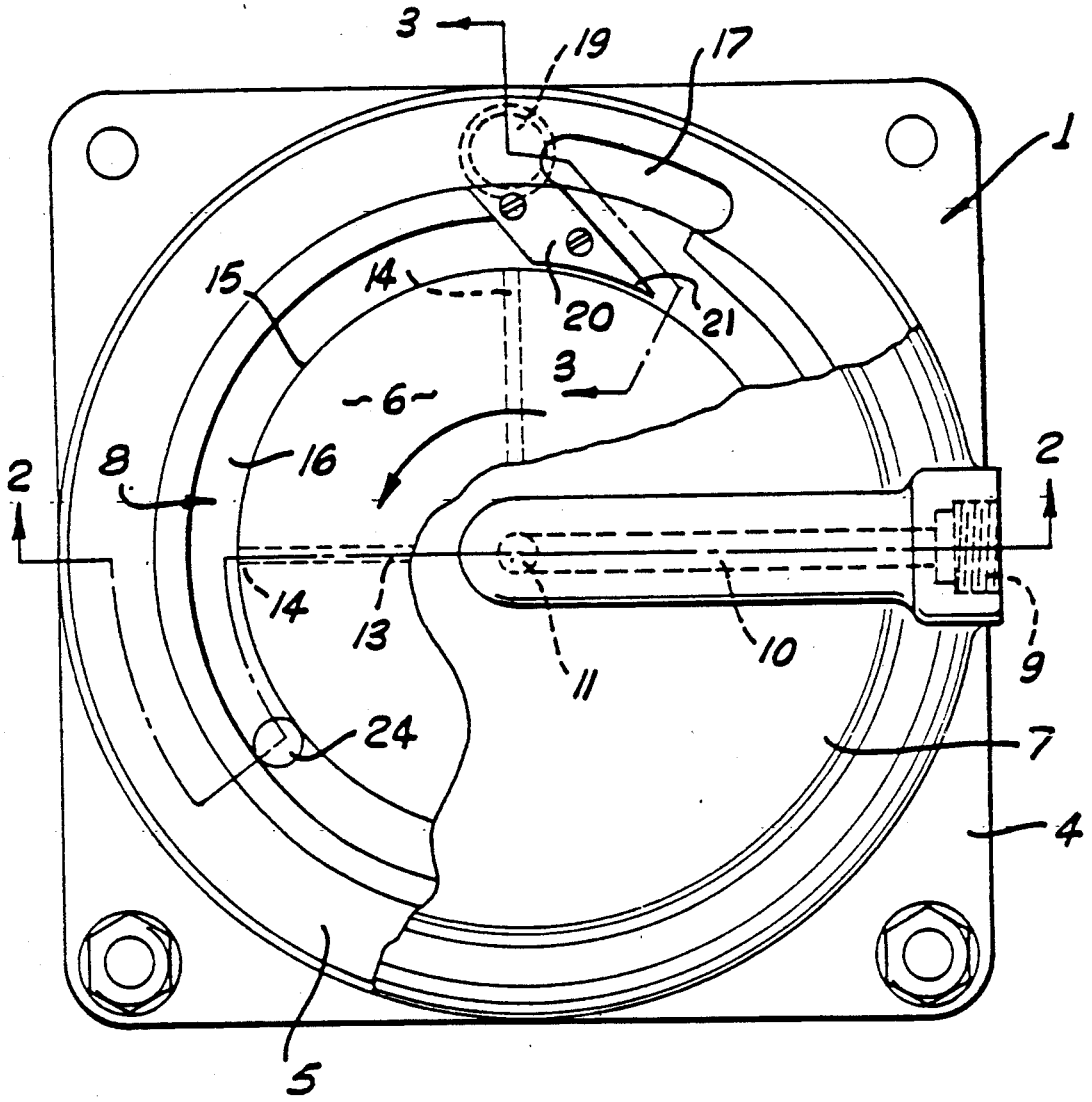
FIG. 1 is a cut-away and elevation of a pump adapted for pumping water and entrained air at low pressures and flow rates.
Figure 2:
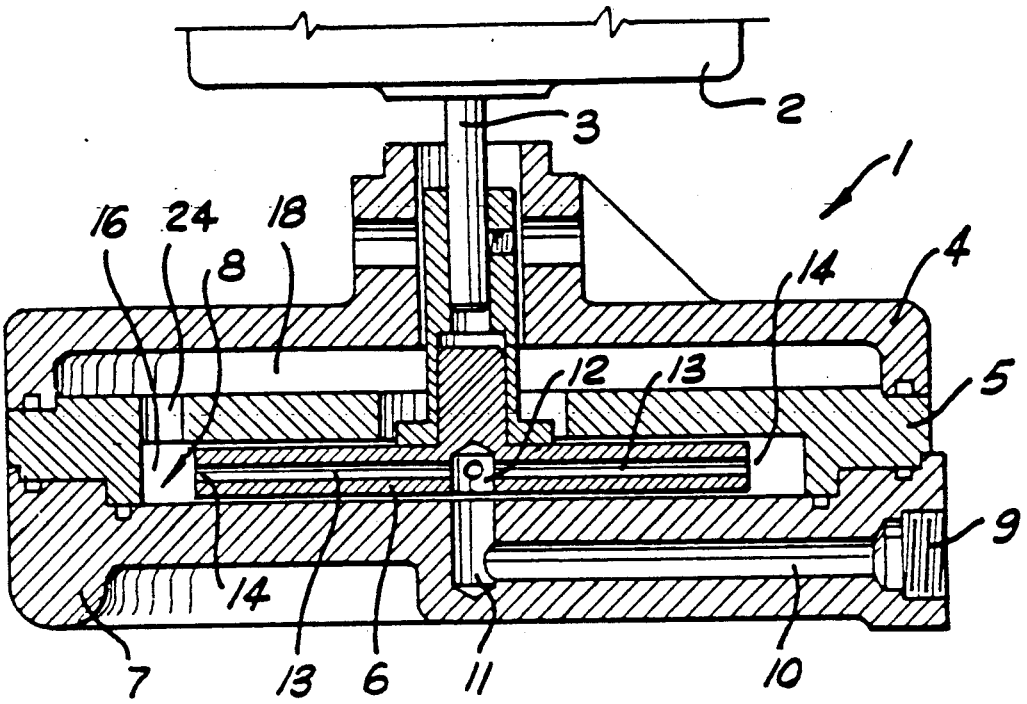
FIG. 2 is a section taken on line 2—2 of FIG. 1.
Figure 3:
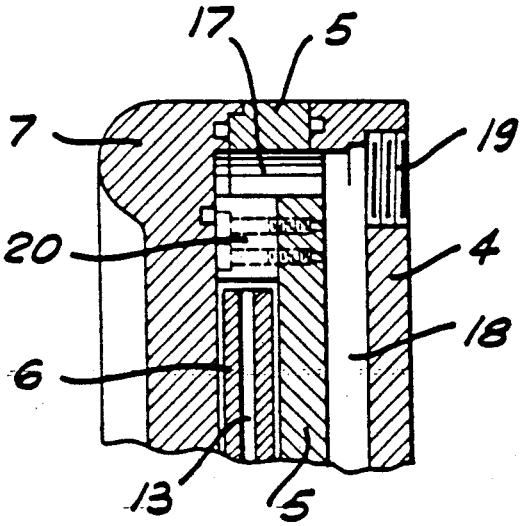
FIG. 3 is a fragmentary section taken on line 3—3 of FIG. 1.

Referring firstly to FIGS. 1 to 3, the pump 1 is driven by an electric drive motor 2 via a horizontally extending central shaft 3. The pump includes four major components, a support housing 4, a dividing wall 5, a impellor 6 and a cover plate 7. The impellor 6 is mounted to the motor drive shaft 3 to rotate within a impellor chamber 8 defined by the space between the dividing wall 5 and the end plate 7.

Water and entrained air enter the pump at inlet port 9, passing through radial passage 10 to an axial passage 11 communicating with the centre of the impellor 6. The impellor 6 is located closely adjacent the adjoining side walls of the impellor chamber 8 and includes a central bore or chamber 12 communicating with a plurality of radial passages 13 extending from the central bore 12 to exit ports 14 spaced around the outer periphery 15 of the impellor 6.

As the impellor rotates, centrifugal action moves the fluid from the pump inlet port 9, outwardly through the impellor passages 13 and into the annular space 16 surrounding the impellor. From the annular space 16 the fluid flows through a port 17 in the dividing wall 5 into a static chamber 18, finally leaving the pump through the rearwardly directed exit port 19.

Rotation of the impellor in the direction shown also imparts a similarly directed peripheral flow velocity to the fluid in the annular space 16. This flow velocity produces a centrifugal separation of fluid and vapour such that any entrained air tends to cling to the impellor periphery 15. This build-up of entrained air adjacent the impellor periphery interferes with flow from the radial passages 13 while tending to accumulate and remain in the impellor chamber as a fresh supply of water and entrained air enters to replace the water leaving the impellor chamber through port 17.

The peripheral flow velocity also has the effect of reducing the relative velocity of fluid moving past the radial passage exit ports 14. It is desirable to have this relative velocity in order to augment the centrifugally induced pressure drop by superimposing a bernoulli effect at the exit port, thereby dropping the pressure still further.

In order to slow the circulating peripheral flow velocity and also to promote the physical removal of segregated air bubbles from closely adjacent the impellor periphery, the invention provides a scoop 20 with its sharp leading edge 21 located as close as possible to the impellor periphery. It will be appreciated that the scoop fulfils two functions in physically removing entrained air and also providing an obstruction in the annular space 16 for slowing the circulating peripheral flow velocity and thereby improving the pump suction characteristics by increasing the bernoulli effect at the impellor exit ports 14.

To further improve the pump performance by promoting removal of entrained air from the impellor chamber, the invention provides a recirculation of substantially air-less water into the peripheral stream upstream of the scoop 20. This is achieved by means of a passage 24 through the dividing wall 5 interconnecting the static chamber 18 with the impellor chamber 8 at a point below the port 17 through which air and water enter the static chamber. Since the flow within the static chamber is relatively slow, entrained air bubbles are able to separate out from the water in the lower part of the static chamber such that the recirculated flow is substantially depleted of air. The velocity of the recirculating water is preferably kept as slow as possible to prevent recirculation of entrained air along with the water. The addition of the substantially airless water into the annular space 16 causes a greater proportion of entrained air to be removed by the scoop 20 than would otherwise have been the case.

FIGS. 4 to 7 illustrate a second pump. Corresponding reference numerals have been used to identify corresponding integers throughout the various embodiments.

Pump 40 is similar in many respects to pump 1 except in that the scoop 20 is replaced by a diffusor ring 41 which surrounds the impellor periphery 15 and is spaced closely thereto.

Figure 7:
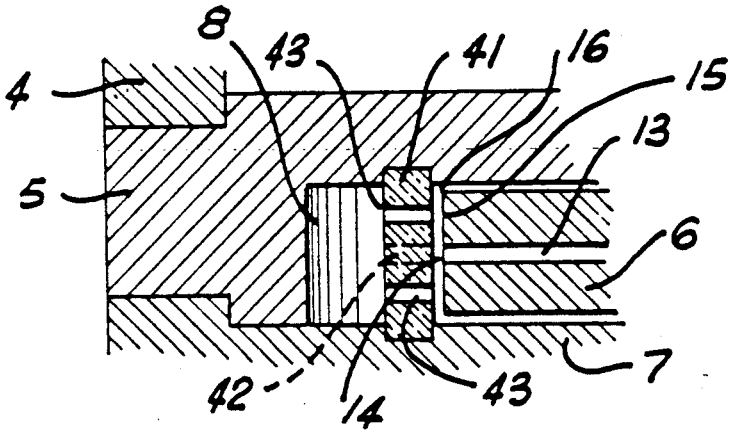
FIG. 7 is an enlarged section taken on line 7—7 of FIG. 5.

The ring 41 has a plurality of generally radially extending passages through it comprising a first circumferential array of passages 42 which are centrally located so that they may come into register with the exit ports 14 of the impellor 6, and a second circumferential array of passages 43 which are arranged in pairs. Each pair of passages 43 is disposed between adjacent passages 42 with the individual passages 43 being axially spaced apart one on either side of the array of passages 42 as shown in FIG. 7. The passages 42 enable water to flow directly from the radial passages 13 to the impellor chamber 8, whilst the passages 43 enable bubbles to escape from the gap between the impellor periphery 15 and the ring 41 to the impeller chamber 8.

Figure 5:
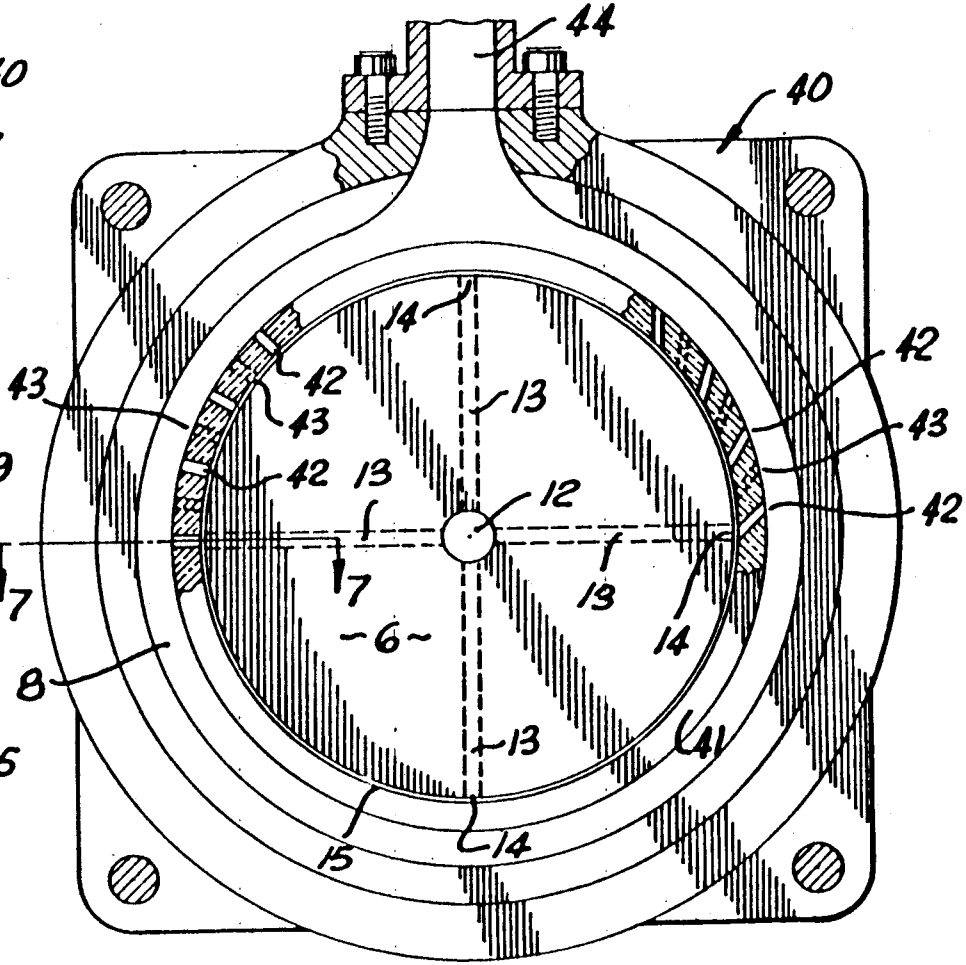
FIG. 5 is a view taken generally on line 5—5 of FIG. 4 with the cover plate removed.
Figure 4:
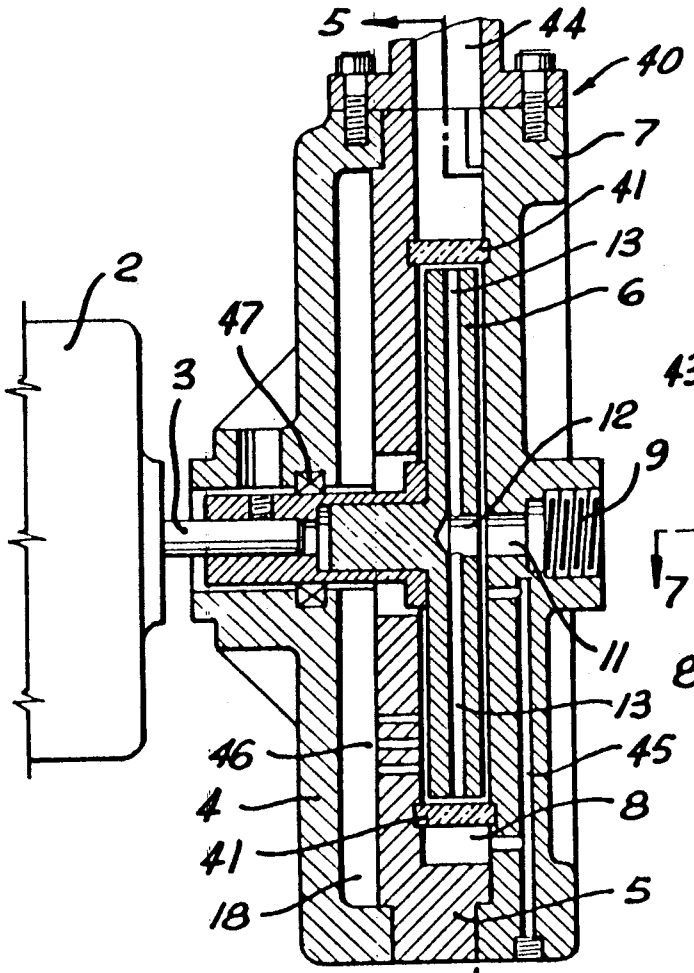
FIG. 4 is a sectional side elevation of a second pump.
Figure 6:
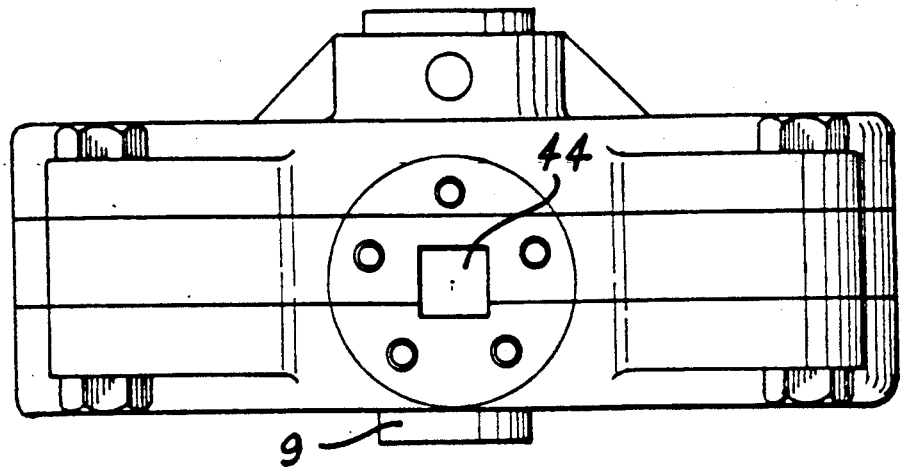
FIG. 6 is a plan view of the pump of FIG. 4.

As can be seen in FIG. 5 the passages 42 and 43 are located only in the nine o'clock to eleven o'clock and the one o'clock to three o'clock sectors. The passages 42 and 43 in the nine o'clock to eleven o'clock sector extend radially whilst those in the one o'clock to three o'clock sector are inclined upwardly. It has been found that this configuration prevents or at least reduces undesirable circulatory flow in the impellor chamber 8. The configuration also causes the flow to be generally in the direction of an upwardly directed exit port 44, which replaces exit port 19 of the first embodiment.

The pump 40 further includes a recirculation passage 45 which extends from the impellor chamber 8 to the radially innermost area of the impellor 6. Water at a higher pressure in the impellor chamber 8 is able to flow through the passage 45 to the innermost area of the impellor face which is at a lower pressure, thereby to reduce the tendency of unwanted air to enter the space between the impellor face and the pump housing from inlet port 9.

Whilst the static chamber 18 of pump 1 is not necessary, it is used to conduct water which flows through the axial passages 46 to a seal 47 to affect its lubrication. It will be appreCiated that the static chamber 18 could be replaced with a suitable duct.

Figure 8:
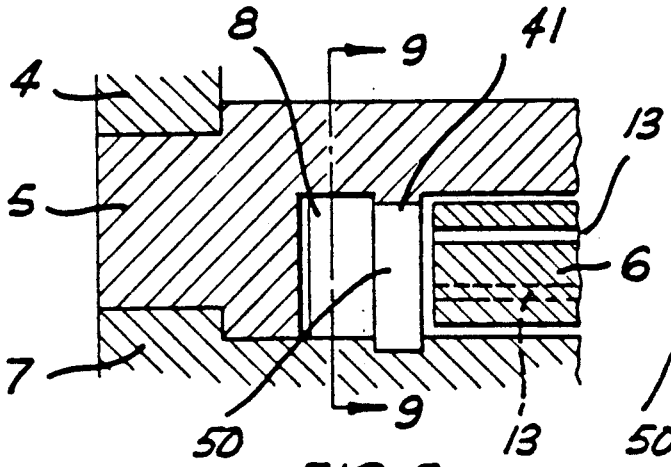
FIG. 8 is a view similar to FIG. 7 but illustrating an alternative arrangement.
Figure 9:
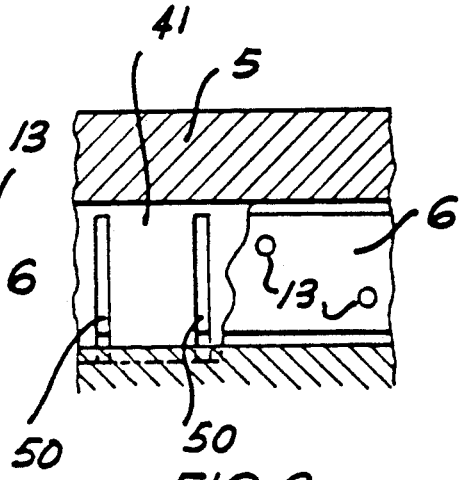
FIG. 9 is a view taken on line 9—9 of FIG. 8.

A third pump is illustrated in FIGS. 8 and 9. This version is similar in most respects to the pump of FIGS. 4 to 7 and corresponding features have been given corresponding reference numerals. However, in this pump the passages 42 and 43 in the diffusor ring 41 have been replaced with a plurality of slots 50. The slots may be all radially extending or some or all of them may be inclined in the same way as the passages shown in FIG. 5.

The ring is preferably formed integral with the dividing wall 5 but it may be separately formed. In this latter case the slots can be cut from both sides of the ring in alternating castellated formation.

The impellor of the third pump includes two axially staggered arrays of equally spaced radial passages 13. For example, a total of 20 radial passages 13 may be equally spaced around the impellor 6. The slots 50 extend a sufficient distance across the diffusor ring 41 to encompass the passages.

Figure 10:
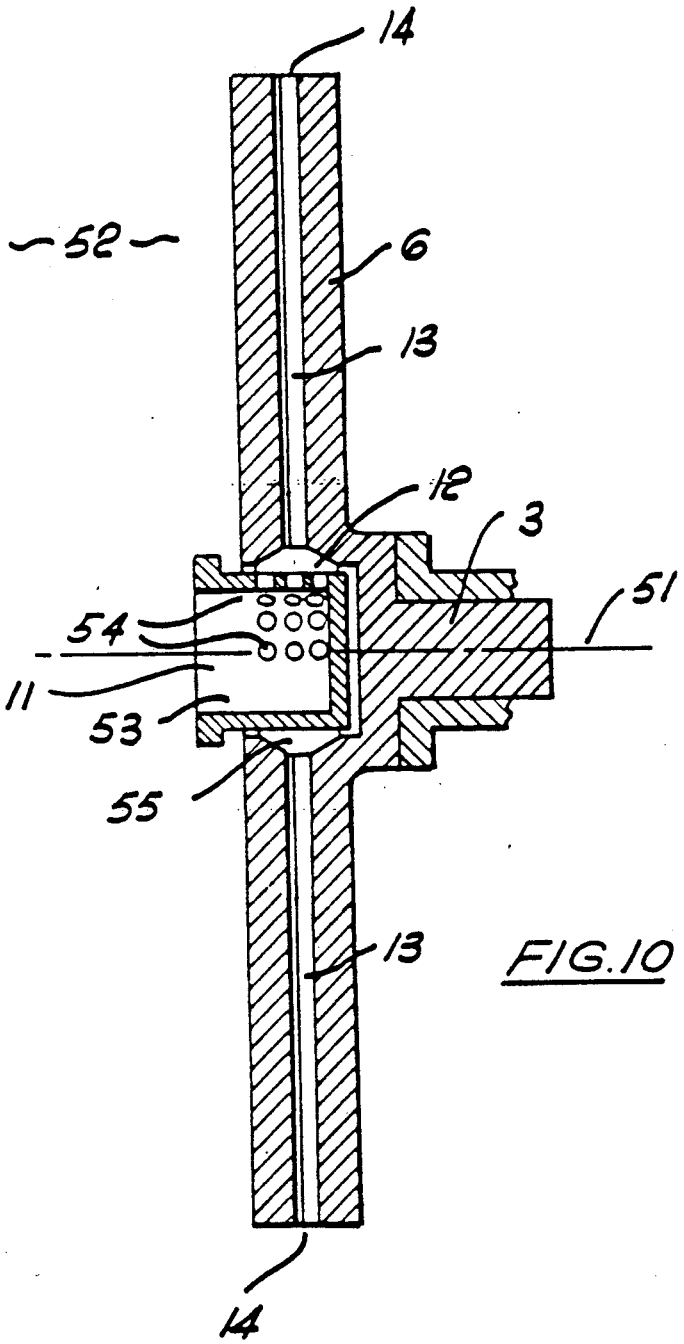
FIG. 10 is a partly sectioned side elevation of a horizontal axis pump embodying the invention and incorporating a stationary inlet port means, termed a "shear tube".

A pump embodying the invention is shown in FIG. 10. In this embodiment the impellor drive shaft axis 51 is horizontal and the impellor is located wholly within a delivery tank volume 52. The pump has no periphery structure since the exit ports 14 deliver directly to the tank.

This embodiment is suitable for low pressure flows at much higher flow rates in the order of many litres per minute. In order to accommodate the entrained vapour the central chamber 12 of the impellor 6 is provided with a stationary inlet port means in the form of a "shear tube" 53. The shear tube 53 is stationary and includes a plurality of delivery ports 54 arranged around the upper half of the tube.

Figure 11:
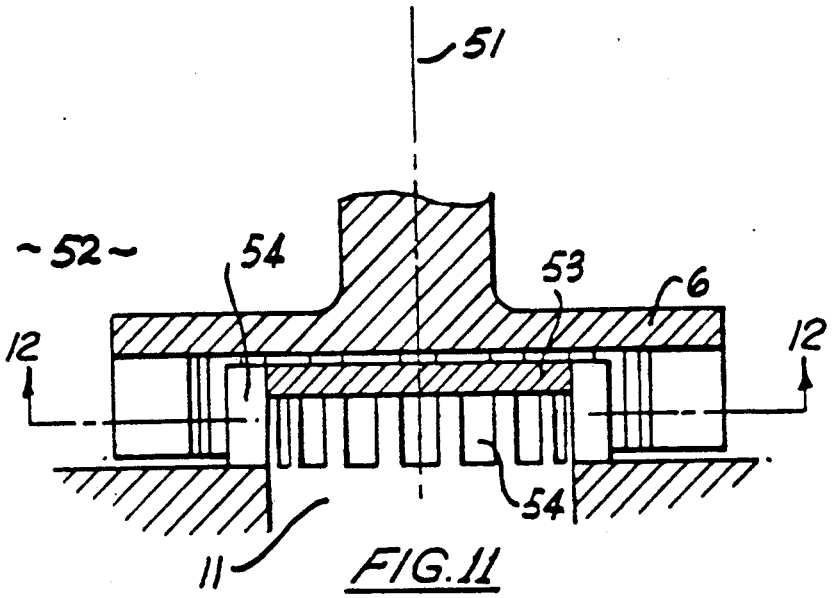
FIG. 11 is a view similar to FIG. 10 but illustrating a second embodiment vertical axis pump incorporating a "shear tube" similar to FIG. 10.

If the impellor of FIG. 10 is disposed with its axis in a vertical orientation the shear tube ports 54 would be disposed around the centre circumference of the shear tube. These may be holes as shown in FIG. 10 or slots as illustrated in FIG. 11. These stationary ports 54 convey incoming fluid from the axial inlet passage to the central chamber 12 of the impellor 6. This chamber 12 is enlarged slightly as shown by the shallow V-sectioned circumferential groove 55 to facilitate supply of fluid to the passages 13.

The shear tube separates the incoming fluid from the spinning impellor and thereby prevents induced rotation of the incoming fluid. This avoids "pre-whirl" - the formation of a gas or vapour pocket along the axial centreline 51 of the pump inlet due to centifugal motion of the incoming fluid and vapour mix. The shearing effect on the liquid/vapour mix as this passeS through the shear tube ports 54 and comes into contact with the spinning inner periphery of the impellor central chamber 12 keeps the vapour interspersed with the liquid as it enters and passes up the impellor passages 13.

Figure 12:
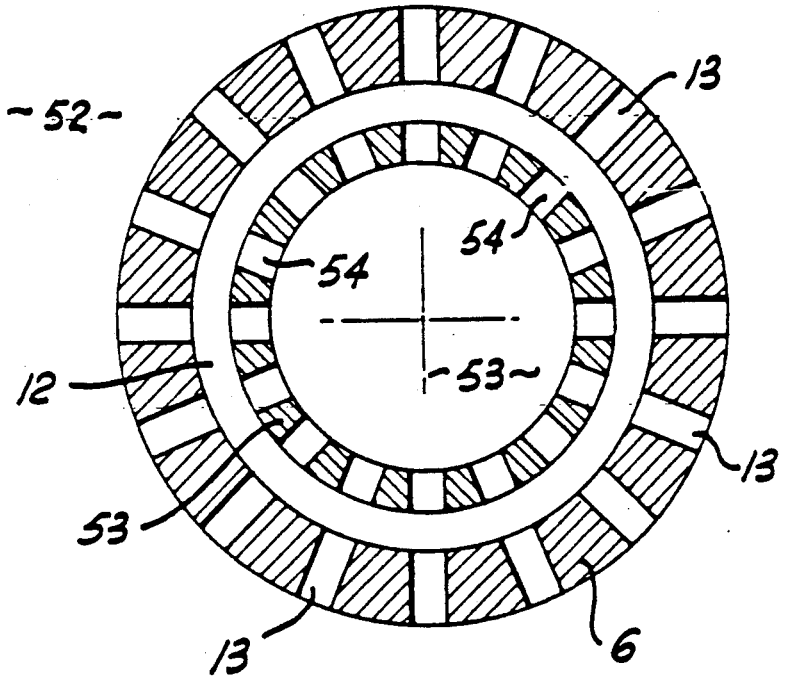
FIG. 12 is a view taken on line 12—12 of FIG. 11.

FIG. 11 illustrates a second embodiment pump similar to the pump of FIG. 10 but with the impellor axis vertical. This pump can also operate wholly within the delivery tank 52 without any peripheral structure surrounding the impellor. In this case the shear tube 53 takes the form of a blind ended extension from a vertically extending axial passage 11. The ports 54 are formed by circumferentially spaced axially elongate slots extending radially outward as best shown in FIG. 12. The shear tube 53 is spaced slightly from the impellor 6 which is itself radially slotted to define a plurality of radially extending passages 13. This embodiment is particularly suited to high flow rates.

If required, the impellor and shear tube arrangements of FIGS. 10, 11 and 12 may be incorporated into the previously described pumps.

Although the invention has been described with reference to specific examples, it will be appreciated by those skilled in the art that the invention may be embodied in many other forms.

I claim:

1. A centrifugal pump having an impellor mounted for rotation about an axis, said impellor having a central inlet chamber with a peripheral wall concentric with said axis and at least one passage extending outwardly from an inlet port in said wall to an exit port radially spaced from said chamber; wherein, stationary inlet port means are located within said chamber for separating the spinning impellor from incoming fluid entering said inlet port means thereby to prevent induced rotation of said incoming fluid, said stationary inlet port means including an annular portion concentric with said axis and in substantial alignment with said impellor inlet port, at least one channel extending radially outwardly from the interior to the exterior of said annular portion for supplying said incoming fluid to said impellor passage.

2. A centrifugal pump according to claim 1 wherein said at least one passage is straight.

3. A centrifugal pump according to claim 1 wherein said at least one passage extends radially outward.

4. A centrifugal pump according to claim 1 wherein said impellor includes a plurality of circumferentially spaced outwardly extending passages, and said stationary inlet port means include a plurality of circumferentially spaced outwardly extending channels.

5. A centrifugal pump according to claim 1 wherein said stationary inlet port means comprises a blind ended extension from an axially extending incoming passage.

6. A centrifugal pump according to claim 1 including means for slowing the peripheral flow velocity of fluid immediately adjacent the impellor periphery.

7. A centrifugal pump according to claim 6 wherein said means for slowing the peripheral flow velocity comprises a scoop having a sharp leading edge located closely adjacent the impellor periphery and directed against the direction of impellor rotation.

8. A centrifugal pump according to claim 6 wherein said means for slowing the peripheral flow velocity comprises a diffusor ring surrounding the impellor periphery and spaced closely thereto, said ring including a plurality of outwardly extending passages.

9. A centrifugal pump according to claim 8 wherein some of said outwardly extending passages are directed in tangentially opposite directions thereby to reduce circulatory flow.

10. A centrifugal pump according to claim 7 including means for recirculating substantially vapour-less fluid into the peripheral stream upstream of said scoop.

11. A centrifugal pump according to any of claims 1 to 9 wherein said impellor is located within its own delivery volume and wholly immersed in previously delivered fluid so as to deliver directly from said impellor to the previously delivered fluid.

* * * * *